US006692075B2

(12) United States Patent
Sander et al.

(10) Patent No.: US 6,692,075 B2
(45) Date of Patent: Feb. 17, 2004

(54) CHAIR HAVING A SYNCHRONOUSLY ADJUSTABLE SEAT AND BACKREST

(75) Inventors: Armin Sander, Waldstrasse 49, D-90763, Fürth (DE); Martin Potrykus, Bamberg (DE); Peter Horn, Nürnberg (DE)

(73) Assignee: Armin Sander, Fuerth (DE)

( * ) Notice: Subject to any disclaimer, the term of this patent is extended or adjusted under 35 U.S.C. 154(b) by 0 days.

(21) Appl. No.: 09/963,008

(22) Filed: Sep. 25, 2001

(65) Prior Publication Data

US 2002/0167208 A1 Nov. 14, 2002

(30) Foreign Application Priority Data

May 11, 2001 (DE) ..... 101 22 946

(51) Int. Cl.[7] ..... A47C 1/02; A47C 1/024

(52) U.S. Cl. ..... 297/316; 297/340; 297/300.1; 297/300.2; 297/302.1

(58) Field of Search ..... 297/340, 341, 297/342, 343, 316, 318, 317, 300.1, 300.2, 302.1

(56) References Cited

U.S. PATENT DOCUMENTS 3,369,840 A * 2/1968 Dufton ..... 297/300.1
4,668,012 A * 5/1987 Locher ..... 297/300.3
4,804,227 A * 2/1989 Hansen ..... 297/300.1
4,854,641 A * 8/1989 Reineman et al. ..... 297/344.15
5,288,138 A * 2/1994 Stulik et al. ..... 713/401
5,308,144 A * 5/1994 Korn ..... 297/300.2
5,354,120 A * 10/1994 Volkle ..... 297/300.1
5,826,940 A * 10/1998 Hodgdon ..... 297/303.1
5,931,531 A * 8/1999 Assmann ..... 297/316
6,000,755 A * 12/1999 Uhlenbrock ..... 297/300.2
6,431,649 B1 * 8/2002 Hensel ..... 297/300.2
6,439,661 B1 * 8/2002 Brauning ..... 297/300.2

FOREIGN PATENT DOCUMENTS

DE 42 19 599 A1 12/1993

* cited by examiner

*Primary Examiner*—Peter M. Cuomo
*Assistant Examiner*—Sarah C. Burnham
(74) *Attorney, Agent, or Firm*—Laurence A. Greenberg; Werner H. Stemer; Ralph E. Locher

(57) ABSTRACT

A chair, in particular an office chair, has a backrest that is articulated on a seat carrier via a backrest carrier, and has a seat surface that can be moved synchronously with the backrest. The front region of the seat surface is connected to the seat carrier via a sliding guide. The rear region of the seat surface is connected to the seat carrier via a seat link. A top point of rotation connects the seat link to the seat surface. A bottom point of rotation connects the seat link to the seat carrier. The distance between the top point of rotation and the backrest is smaller than the distance between the bottom point of rotation and the backrest. A sliding guide for the seat surface is provided in the backrest carrier for synchronizing the movement of the backrest and the movement of the seat surface.

14 Claims, 2 Drawing Sheets

CHAIR HAVING A SYNCHRONOUSLY ADJUSTABLE SEAT AND BACKREST

BACKGROUND OF THE INVENTION

Field of the Invention

The invention relates to a chair, in particular an office chair, having a backrest that is articulated on a seat that can be moved synchronously with the backrest. A sliding guide connects the front region of the seat to a seat carrier and a seat link connects the rear region of the seat to the seat carrier.

Seating furniture and, in particular, chairs in which the seat surface and the backrest move synchronously are used with various synchronizing mechanisms. The synchronizing mechanism serves to change the position of the seat surface at the same time as the backrest is adjusted.

A chair in which the inclination of the backrest and the seat is synchronously adjustable is known from published German Patent Application DE 42 19 599 A1. In the case of this chair, as the inclination of the backrest increases, the seat surface is raised by a seat link that is articulated on the rear region of the seat surface and on the seat carrier. The seat surface is drawn in the rearward direction at the same time by a drag lever that is connected rotatably to the seat surface and to the backrest link. Because of this raising action of the seat surface in the rear region, which is directed toward the backrest, the user may slide forward on the seat surface as the backrest leans back.

With a synchronous movement of the backrest and seat surface, however, the seat surface should be inclined in the rearward and downward directions at least to the extent where the pushing force exerted by the user as he/she leans back on the seat or the seat surface is absorbed.

SUMMARY OF THE INVENTION

It is accordingly an object of the invention to provide a chair which overcomes the above-mentioned disadvantageous of the prior art apparatus of this general type. More specifically, it is an object of the invention to provide a chair, in particular an office chair, with a particularly suitable synchronizing mechanism that can be realized in a straightforward manner.

With the foregoing and other objects in view there is provided, in accordance with the invention, a chair, in particular, an office chair that includes: a seat carrier; a backrest; a backrest carrier articulating the backrest on the seat carrier; and a seat having a front region, a rear region, and a seat surface that is defined by the front region and the rear region. The seat surface is configured for moving synchronously with the backrest. The chair also includes a first sliding guide connecting the front region to the seat carrier; a seat link connecting the rear region to the seat carrier; a second sliding guide located in the backrest carrier for synchronizing a movement of the backrest and a movement of the seat surface; a top connection that connects the seat link to the seat and that defines a top point of rotation; and a bottom connection that connects the seat link to the seat carrier and that defines a bottom point of rotation. The top point of rotation is located to define a distance that is between the top point of rotation and the backrest. The bottom point of rotation is located to define a distance that is between the bottom point of rotation and the backrest. The distance that is between the top point of rotation and the backrest is smaller than the distance that is between the bottom point of rotation and the backrest.

In accordance with an added feature of the invention, the top connection includes a slot that guides the top point of rotation, and the slot is formed in the backrest carrier.

In accordance with an additional feature of the invention, the first sliding guide is located in the front region of the seat and the first sliding guide runs obliquely downward toward the seat carrier.

In accordance with a further feature of the invention, the seat link is curved concavely towards the seat.

In accordance with a further added feature of the invention, the seat link has a concave surface located opposite the seat.

In accordance with a further additional feature of the invention, there is provided, a connection that connects the backrest carrier to the seat carrier and that defines an additional point of rotation. The backrest has a rearwardly inclined position in which the top point of rotation is located at a lower level in relation to the seat surface than the additional point of rotation.

On the one hand, the distance between the top point of rotation, which connects the seat link to the seat surface, and the backrest is smaller than the distance between the bottom point of rotation, which connects the seat link to the seat carrier, and the backrest. Thus, as the inclination of the backrest increases, the seat surface, rather than being raised, is advantageously lowered. On the other hand, a sliding guide for the seat surface is provided in the backrest link for synchronization between the movement of the backrest and the movement of the seat surface.

The invention is based here on the consideration that, in the case of a chair or piece of seating furniture with an adjustable seat surface and an adjustable backrest, the possible adjustments of the seat surface, on the one hand, and backrest, on the other hand, may first of all be regarded independently of one another. The design thus initially has two degrees of freedom. The possible adjustment of the backrest here has just a single degree of freedom if the backrest is articulated on the seat carrier in a straightforward manner via the backrest carrier, which is connected rigidly to the backrest and is fastened rotatably on the seat carrier via a single rotary spindle. Furthermore, the seat surface may have more complex possible adjustments, although, in a manner analogous to the adjustability of the backrest, it may be assumed that it is also possible to describe the possible adjustments of the seat surface with a single degree of freedom. The movement of the seat surface here may be both a translation and a tilting movement or a combination of different types of movement.

Coupling the movements of the seat surface, on the one hand, and of the backrest, on the other hand, should first of all ensure that each possible position of the backrest is assigned a position of the seat surface, as a result of which the entire design is limited to one degree of freedom. These requirements and a coupling mechanism that has a permanently stable and a straightforward design, are fulfilled by providing a sliding guide for the seat surface in the backrest link. A particularly straightforward synchronizing mechanism is thus provided overall.

For this purpose, the seat surface may be guided in a slot, provided in the backrest link, via a rigid spindle which is connected to the seat surface. Advantageously, however, the top point of rotation, which is common to the seat surface and the seat link, is guided in a corresponding slot in the backrest link. It is expedient here for the seat link to be configured such that it is curved concavely in the direction of the seat surface.

The sliding guide provided in the front seat region may be realized by a slot provided in the seat carrier and a spindle which is connected rigidly to the seat surface, or by a cylinder. Irrespective of this, a sliding guide which runs obliquely downward in the direction of the seat carrier is advantageously provided. By virtue of the inclined arrangement of the front sliding guide of the seat surface, the sliding guide acting as length-compensation element, undesired raising of the front edge of the seat surface as the backrest is inclined back is avoided, and in addition, the front edge of the seat surface is lowered as the backrest is inclined back. This lowering action becomes more pronounced, the more the inclination of the sliding guide deviates from the horizontal and runs in the direction of the vertical.

From the point of view of ergonomics, the comfort is increased by the forward and downward inclination of the seat link, starting from the top point of rotation, which is connected to the seat surface, of the seat link. As the backrest is inclined back, the seat surface is lowered predominantly in its rear region, while, at the same time, the front edge of the seat surface moves in the rearward and downward directions. As a result, the seat surface achieves, as desired, a greater freedom of movement in its rear region than in its front region.

Other features which are considered as characteristic for the invention are set forth in the appended claims.

Although the invention is illustrated and described herein as embodied in chair, in particular office chair, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
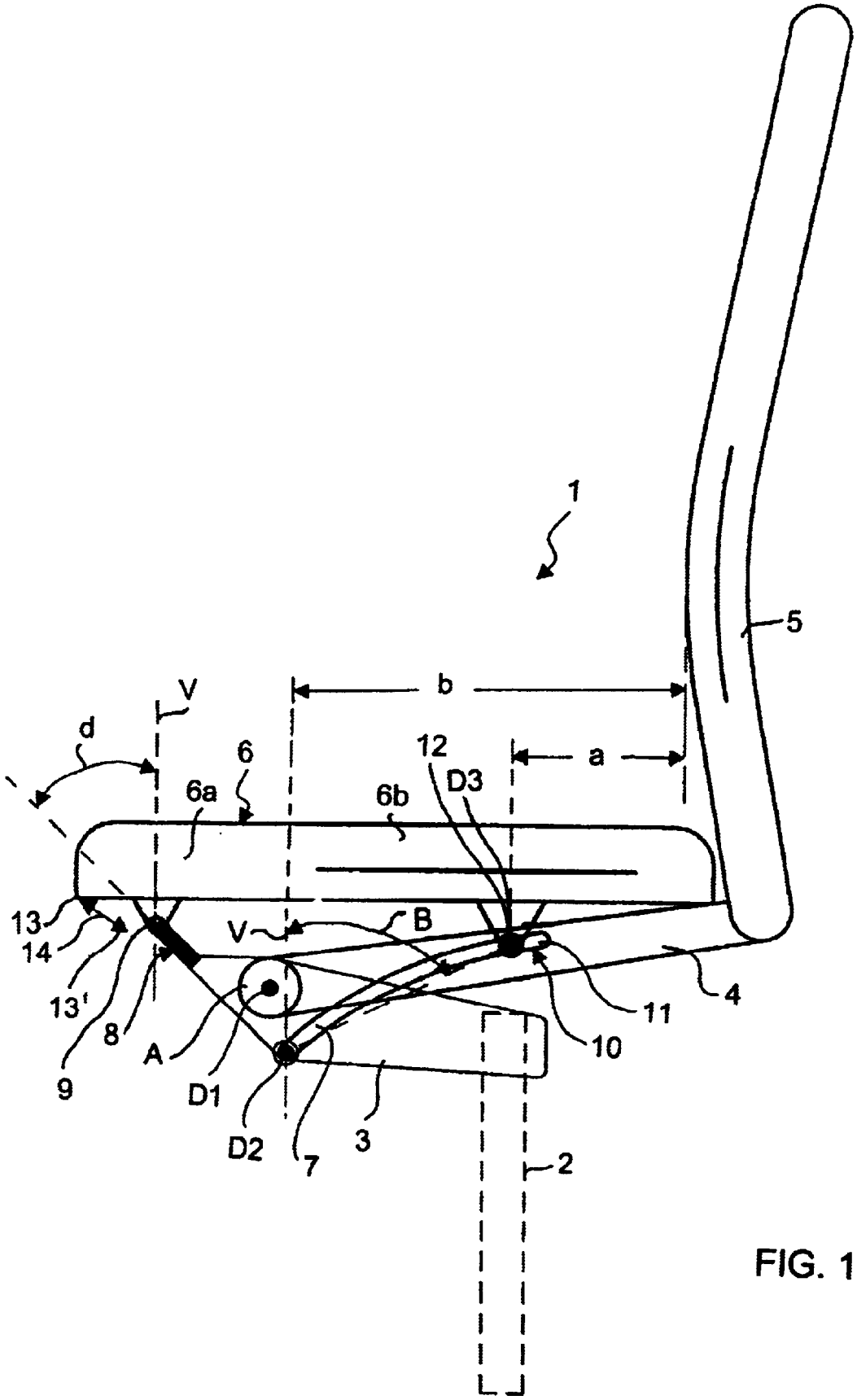
FIG. 1 is a schematic side view of an office chair in the rest position.
Figure 2:
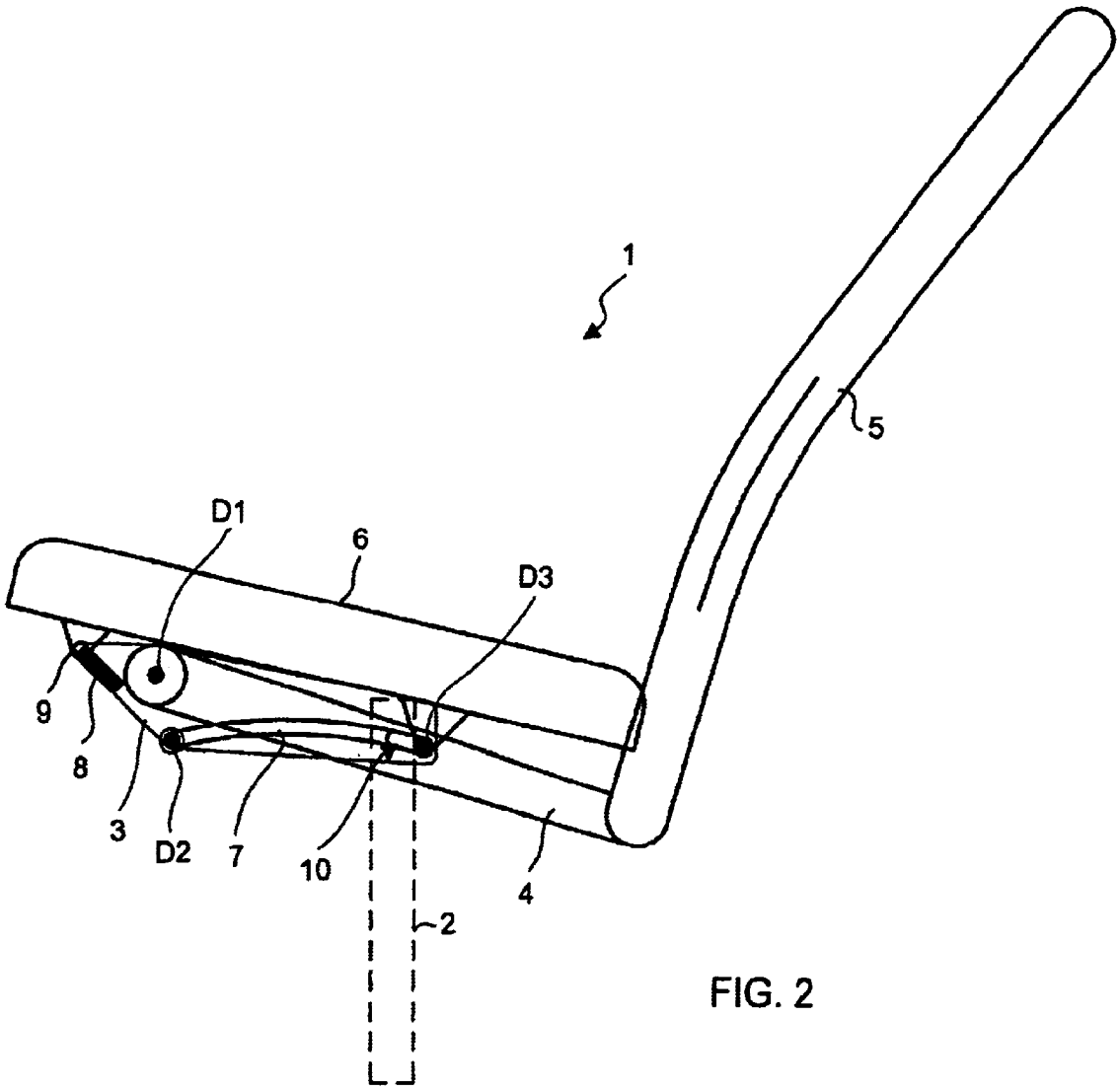
FIG. 2 is a schematic side view of the office chair shown in FIG. 1 in the rearwardly inclined end position.

Referring now to the figures of the drawing in detail and first, particularly, to FIG. 1 thereof, there is shown an office chair 1 that includes a seat carrier 3 which is fixed to a stand 2 (illustrated by dashed lines). A backrest 5 is rotatably connected to the seat carrier 3 via a backrest carrier 4. The backrest 5 can be inclined here in the rearward direction out of the rest position, which is shown in FIG. 1, into the rearwardly inclined position, which is illustrated in FIG. 2. The backrest 5 is inclined here by rotation about a point of rotation D1. For this purpose, the backrest carrier 4, which is fixed to the backrest 5, is connected to the seat carrier 3 via a rotary spindle A. The point of rotation D1 is realized essentially by the center axis of the rotary spindle A.

A seat surface 6 is also articulated on the seat carrier 3 via a seat link 7, which in the exemplary embodiment is configured such that it is curved convexly in the direction of the seat surface 6. The seat link 7 is rotatably connected to the seat carrier 3 by a rotary articulation D2. The seat link 7 is also rotatably connected to the rear region of the seat surface 6, i.e. the rear seat half 6*b*, which is directed toward the backrest 5, by a rotary articulation D3. The points of rotation D2 and D3, in turn, are realized by corresponding rotary spindles, via which the seat link 7 is connected rotatably to the seat carrier 3, on the one hand, and to the seat surface 6, on the other hand.

In the front region, i.e. in the front seat half 6*a*, which is directed away from the backrest 5, the seat surface 6 is connected to the seat carrier 3 by a sliding guide 8. The sliding guide 8 may be configured, in a manner which is not illustrated specifically, as a slot in the seat carrier 3 and a rigid spindle 9, which is guided therein and is connected to the seat surface 6, or—as is illustrated—as a cylinder guided in the seat carrier 3. The cylinder is then connected rotatably to the seat surface 6 via the spindle 9. In this case, the sliding guide 8 is inclined in the direction of the stand 2. The angle of inclination a between the sliding guide 8 and the vertical V in this case is $\alpha=(45\pm30)°$, where $\alpha$ is preferably 45°.

For synchronizing the movement of the backrest 5 and the movement of the seat surface 6, the latter is guided in a sliding guide 10 provided in the backrest carrier 4. In this case, a slot 11 is expediently provided in the backrest carrier 4. A spindle 12, which forms the point of rotation D3 between the seat surface 6 and the seat link 7, is guided in the slot 11. Alternatively, it is also possible to provide a separate spindle 12 on the seat surface 6 in this region, which then does not coincide with the point of rotation D3.

If the backrest 5 is inclined rearward into the position illustrated in FIG. 2, then, by virtue of this inclination, the backrest carrier 4 is rotated in the clockwise direction and, as a result, the seat link 7 together with the seat surface 6 is moved downward. In this case, the angle $\beta$ between the seat link 7 and the vertical V of approximately 45° to 60° increases to approximately 90°. In the end position, the seat link 7 is thus located more or less horizontally.

As a result of the inclination of the backrest 5, together with the point of rotation D3, the rear region 6*b* of the seat surface 6 is lowered. At the same time, the front edge 13 of the seat surface 6 moves in the rearward and downward directions, the length compensation which is necessary for this purpose taking place by way of the front sliding guide 8. The length of the arrow 14 shown in FIG. 1 illustrates the resulting displacement of the front edge 13 of the seat surface 6 to the point 13'. The front seat edge 13 is lowered to a lesser extent than the rear region 6*b* of the seat surface 6, with the result that the latter, as a whole, is lowered and inclined in the clockwise direction.

In the rearwardly inclined position, the top point of rotation D3, which connects the seat link 7 to the seat surface 6, is located at a lower level in relation to the seat surface 6 than the point of rotation D1, which connects the backrest carrier 4 to the seat carrier 3. In the rest position, however, the point of rotation D1 is located beneath the point of rotation D3.

We claim:

1. A chair, comprising:

a seat carrier;

a backrest;

a backrest carrier rotatably connecting said backrest to said seat carrier;

a seat having a front region, a rear region, and a seat surface defined by said front region and said rear region, said seat surface configured for moving in rearward and downward directions synchronously with said backrest;

a first sliding guide connecting said front region to said seat carrier;

a seat link rotatably connecting said rear region to said seat carrier;

a second sliding guide located in said backrest carrier for synchronizing a movement of said backrest and a movement of said seat surface;

a top connection connecting said seat link to said seat and defining a top point of rotation;

a bottom connection connecting said seat link to said seat carrier and defining a bottom point of rotation;

said top point of rotation located to define a distance between said top point of rotation and said backrest;

said bottom point of rotation located to define a distance between said bottom point of rotation and said backrest;

said distance between said top point of rotation and said backrest being smaller than said distance between said bottom point of rotation and said backrest.

2. The chair according to claim 1, wherein said top connection includes a slot that guides said top point of rotation, and said slot is formed in said backrest carrier.

3. The chair according to claim 2, wherein said first sliding guide is located in said front region of said seat and said first sliding guide runs obliquely downward toward said seat carrier.

4. The chair according to claim 1, wherein said first sliding guide is located in said front region of said seat and said first sliding guide runs obliquely downward toward said seat carrier.

5. The chair according to claim 1, wherein said seat link is curved concavely towards said seat.

6. The chair according to claim 1, wherein said seat link has a concave surface located opposite said seat.

7. The chair according to claim 1, further comprising:

a connection connecting said backrest carrier to said seat carrier and defining an additional point of rotation;

said backrest having a rearwardly inclined position in which said top point of rotation is located at a lower level in relation to said seat surface than said additional point of rotation.

8. An office chair, comprising:

a seat carrier;

a backrest;

a backrest carrier rotatably connecting said backrest to said seat carrier;

a seat having a front region, a rear region, and a seat surface defined by said front region and said rear region, said seat surface configured for moving in rearward and downward directions synchronously with said backrest;

a first sliding guide connecting said front region to said seat carrier;

a seat link rotatably connecting said rear region to said seat carrier;

a second sliding guide located in said backrest carrier for synchronizing a movement of said backrest and a movement of said seat surface;

a top connection connecting said seat link to said seat and defining a top point of rotation;

a bottom connection connecting said seat link to said seat carrier and defining a bottom point of rotation;

said top point of rotation located to define a distance between said top point of rotation and said backrest;

said bottom point of rotation located to define a distance between said bottom point of rotation and said backrest;

said distance between said top point of rotation and said backrest being smaller than said distance between said bottom point of rotation and said backrest.

9. The office chair according to claim 8, wherein said top connection includes a slot that guides said top point of rotation, and said slot is formed in said backrest carrier.

10. The office chair according to claim 8, wherein said first sliding guide is located in said front region of said seat and said first sliding guide runs obliquely downward toward said seat carrier.

11. The office chair according to claim 9 wherein said first sliding guide is located in said front region of said seat and said first sliding guide runs obliquely downward toward said seat carrier.

12. The office chair according to claim 8, wherein said seat link is curved concavely towards said seat.

13. The office chair according to claim 8, wherein said seat link has a concave surface located opposite said seat.

14. The chair according to claim 8, further comprising:

a connection connecting said backrest carrier to said seat carrier and defining an additional point of rotation;

said backrest having a rearwardly inclined position in which said top point of rotation is located at a lower level in relation to said seat surface than said additional point of rotation.

* * * * *